US011582997B2

(12) United States Patent
Emmett

(10) Patent No.: US 11,582,997 B2
(45) Date of Patent: Feb. 21, 2023

(54) AEROSOL GENERATING ARTICLE HAVING A MOUTHPIECE WITH A MODIFIED STRUCTURE

(71) Applicant: Philip Morris Products S.A., Neuchatel (CH)

(72) Inventor: Robert Emmett, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 37 days.

(21) Appl. No.: 16/648,853

(22) PCT Filed: Nov. 28, 2018

(86) PCT No.: PCT/EP2018/082888
§ 371 (c)(1),
(2) Date: Mar. 19, 2020

(87) PCT Pub. No.: WO2019/106040
PCT Pub. Date: Jun. 6, 2019

(65) Prior Publication Data

US 2020/0281262 A1 Sep. 10, 2020

(30) Foreign Application Priority Data

Nov. 28, 2017 (EP) ..... 17204221

(51) Int. Cl.
*A24D 3/04* (2006.01)
*A24D 3/17* (2020.01)
(Continued)

(52) U.S. Cl.
CPC ..... *A24D 3/04* (2013.01); *A24D 1/02* (2013.01); *A24D 1/20* (2020.01); *A24D 3/17* (2020.01); *A24D 3/18* (2013.01)

(58) Field of Classification Search
CPC ..... A24D 3/0283; A24D 3/043; A24D 3/02; A24D 3/18; A24D 3/04; A24D 1/20
See application file for complete search history.

(56) References Cited

U.S. PATENT DOCUMENTS 3,805,801 A * 4/1974 Berger ..... A24D 3/0283 131/340
4,022,221 A 5/1977 Berger
(Continued)

FOREIGN PATENT DOCUMENTS

CH 562 575 A5 6/1975
CN 202819630 U 3/2013
(Continued)

OTHER PUBLICATIONS

International Search Report and Written Opinion dated Feb. 28, 2019 in PCT/EP2018/082888 filed Nov. 28, 2018.
(Continued)

*Primary Examiner* — Niki Bakhtiari
*Assistant Examiner* — Stephanie Lynn Moore
(74) *Attorney, Agent, or Firm* — Oblon, McClelland, Maier & Neustadt, L.L.P.

(57) ABSTRACT

An aerosol-generating article is provided, including an aerosol-generating substrate; and a mouthpiece disposed downstream of the aerosol-generating substrate, a peripheral region of the mouthpiece including one or more closed pockets of air.

20 Claims, 3 Drawing Sheets

(51) Int. Cl.

| | |
|---|---|
| ***A24D 1/20*** | (2020.01) |
| ***A24D 1/02*** | (2006.01) |
| ***A24D 3/18*** | (2006.01) |

(56) References Cited

U.S. PATENT DOCUMENTS

| | | | | |
|---|---|---|---|---|
| 4,075,936 | A | 2/1978 | Berger | |
| 4,559,955 | A | 12/1985 | Brockway et al. | |
| 4,583,560 | A | 4/1986 | Sakai et al. | |
| 4,620,557 | A | 11/1986 | Cantrell et al. | |
| 5,178,166 | A * | 1/1993 | Newsome | A24D 3/043 131/336 |
| 8,997,754 | B2 * | 4/2015 | Tucker | H05B 1/0244 131/273 |
| 2014/0270726 | A1 | 9/2014 | Egoyants et al. | |
| 2016/0088875 | A1 | 3/2016 | Egoyants et al. | |
| 2017/0071251 | A1 | 3/2017 | Goch | |
| 2017/0095006 | A1 | 4/2017 | Egoyants et al. | |
| 2017/0164654 | A1 | 6/2017 | Ademe | |
| 2018/0042302 | A1 | 2/2018 | Robinson et al. | |
| 2019/0046741 | A1 | 2/2019 | Lord et al. | |

FOREIGN PATENT DOCUMENTS

| | | | |
|---|---|---|---|
| CN | 105212274 | A | 1/2016 |
| DE | 20 2014 001 718 | U1 | 5/2015 |
| EP | 0 099 225 | A1 | 1/1984 |
| GB | 1 308 661 | A | 2/1973 |
| GB | 2 118 424 | A | 11/1983 |
| GB | 2 170 695 | B | 9/1988 |
| GB | 2547699 | A | 8/2017 |
| JP | 52-57398 | A | 5/1977 |
| JP | 57-132873 | A | 8/1982 |
| JP | 59-11170 | A | 1/1984 |
| JP | 59-63179 | A | 4/1984 |
| JP | 2001-120249 | A | 5/2001 |
| JP | 2017-506890 | A | 3/2017 |
| JP | 3208926 | U | 3/2017 |
| RU | 2 114 538 | C1 | 7/1998 |
| WO | WO 2007/135414 | A1 | 11/2007 |
| WO | WO 2013/034458 | A1 | 3/2013 |
| WO | WO 2014/020055 | A1 | 2/2014 |
| WO | WO 2015/127120 | A1 | 8/2015 |
| WO | WO 2016/107762 | A1 | 7/2016 |
| WO | WO 2016/107768 | A1 | 7/2016 |
| WO | WO 2017/125846 | A1 | 7/2017 |

OTHER PUBLICATIONS

Combine Chinese Office Action and Search Report dated Dec. 23, 2021 in Chinese Patent Application No. 201880071596.0 (with English translation), 15 pages.

Combine Russian Federation Office Action and Search Report dated Dec. 15, 2021 in Russian Federation Patent Application No. 2020117592/03(029566) (with English translation), 15 pages.

European Office Action dated Aug. 11, 2021 in European Patent Application No. 18808012.1, 5 pages.

Notice of Reasons for Rejection dated Nov. 7, 2022 in Japanese Patent Application No. 2020-520120 filed Nov. 28, 2018, (with translation, total 20 pages).

* cited by examiner

AEROSOL GENERATING ARTICLE HAVING A MOUTHPIECE WITH A MODIFIED STRUCTURE

The invention relates to aerosol-generating articles having a mouthpiece with a modified structure. The invention is particularly applicable to aerosol-generating articles in which an aerosol forming substrate, such as tobacco, is heated rather than combusted.

Filter cigarettes are one example of aerosol-generating articles. Filter cigarettes typically comprise a rod of tobacco cut filler surrounded by a paper wrapper and a cylindrical filter aligned in end-to-end relationship with the wrapped tobacco rod, with the filter attached to the tobacco rod by tipping paper. In conventional filter cigarettes, the filter may consist of a plug of cellulose acetate tow wrapped in porous plug wrap. Filter cigarettes with multi-component filters that comprise two or more segments of filtration material for the removal of particulate and gaseous components of the mainstream smoke are also known. Aerosol-generating articles having a cavity at their mouth end have also been proposed.

A number of aerosol-generating articles in which an aerosol forming substrate, such as tobacco, is heated rather than combusted have also been proposed in the art. In heated aerosol-generating articles, the aerosol is generated by heating the aerosol forming substrate. Known heated aerosol-generating articles include, for example, aerosol-generating articles in which an aerosol is generated by electrical heating or by the transfer of heat from a combustible fuel element or heat source to an aerosol forming substrate. During use, volatile compounds are released from the aerosol forming substrate by heat transfer from the heat source and entrained in air drawn through the aerosol-generating article. As the released compounds cool, they condense to form an aerosol that is inhaled by the consumer. Also known are aerosol-generating articles in which a nicotine-containing aerosol is generated from a tobacco material, tobacco extract, or other nicotine source, without combustion, and in some cases without heating, for example through a chemical reaction.

It may be desirable to maintain an acceptable temperature in certain parts of the aerosol-generating article, such as on one or more portions of the external surface of the article. Such one or more portions of the article may include a portion or portions which are likely to contact the user's lips or fingers during use.

One known way to maintain at an acceptable temperature in certain parts of the aerosol-generating article is to cool the aerosol. The aerosol can be cooled by including ventilation holes at certain locations on the aerosol-generating article. Such holes allow external air to dilute and cool the aerosol before it reaches the consumer. As another example, in some types of aerosol-generating articles, an aerosol-cooling element can be included downstream of the aerosol-forming substrate. The aerosol-cooling element may be a gathered sheet of material which has a large surface area, such that the aerosol is cooled as it passes through the aerosol-cooling element.

However, such cooling mechanisms may not always be suitable. For example, it may not always be suitable to have the additional effect of dilution when seeking to cool the aerosol. Furthermore, it may not always be suitable to allocate space within the aerosol-generating article to a dedicated aerosol-cooling element. Accordingly, it would be desirable to provide an improved or alternative way to prevent the aerosol from overly heating certain parts of the aerosol-generating article as the aerosol passes through the article.

According to a first aspect of the present invention, there is provided an aerosol-generating article comprising: an aerosol-generating substrate and a mouthpiece disposed downstream of the aerosol-generating substrate, wherein the peripheral region of the mouthpiece comprises one or more closed pockets of air.

By providing one or more closed pockets of air in a peripheral region of the mouthpiece insulation can be provided in the aerosol-generating article. The insulation can reduce the amount of heat transferred from the aerosol to the outer surface of the aerosol-generating article, as the aerosol passes through the aerosol-generating article. This advantageously means that parts of the article which are likely to contact the user's lips or fingers during use, are less likely to be overly heated by the aerosol as the aerosol passes through the aerosol-generating article. Consequently, a consumer can consume an article according to the present invention, without perceiving an overly high temperature when they contact the article, for example with their lips or fingers.

The term 'closed pocket' is used herein to indicate that the pocket of air is fully enclosed by one or more surrounding walls. The surrounding walls retain the air in the pocket and prevent air from being drawn in or out of the pocket. In particular, the surrounding walls prevent air from being drawn in or out of the pocket when a user draws on the aerosol-generating article. No holes, such as perforation holes, are provided in the surrounding walls. Preferably, each of the one or more surrounding walls has a porosity of less than about 1000 Coresta units, more preferably less than about 500 Coresta units, and even more preferably less than about 100 Coresta units. The porosity may be as low as 100 Coresta units. In addition, or in the alternative, the porosity may be more than about 1 Coresta unit.

By forming the pockets as closed pockets, air within the pockets cannot mix with the aerosol as the aerosol passes through the article. This means that air within the pockets will not act to dilute the aerosol that flows through the article. The aerosol can instead flow through an inner region of the article, through portions of the peripheral region which do not contain the closed pockets, or both. The cooling mechanism of the closed pockets can therefore be incorporated into an existing component of the aerosol-generating article, and thus reduce or eliminate the need for a dedicated aerosol-cooling element being provided within the aerosol-generating article.

As used herein, the terms "upstream" and "downstream" are used to describe the relative positions of features of the aerosol-generating article according to the invention in relation to the direction of aerosol drawn from the aerosol generating substrate through the mouthpiece during use. For example, in a mouthpiece where a cavity is upstream of a mouth end segment, aerosol is drawn first through the cavity and then through the mouth end segment.

The term "inner surface" is used throughout the specification to refer to the surface of a component of the aerosol-generating article that is facing towards the interior of the aerosol-generating article. On the other hand, the term "outer surface" is used throughout the specification to refer to the surface of a component of the article that is facing towards the exterior of the article. For example, a wrapper circumscribing a mouthpiece segment comprises an outer surface that is facing the exterior of the aerosol-generating article and an inner surface that is facing towards the mouthpiece segment.

As used herein, the term "longitudinal" refers to a direction parallel to the length of the aerosol-generating article.

The term 'air' is used herein to refer to any composition which is a gas at room temperature (23 degrees Celsius). Therefore, the term 'air' could be used interchangeably in the present specification for the term 'gas'. Furthermore, a liquid could be used in the one or more pockets of the present invention to provide insulation instead of, or in addition to, a gas.

Accordingly, a second aspect of the present invention provides an aerosol-generating article comprising: an aerosol-generating substrate and a mouthpiece disposed downstream of the aerosol-generating substrate, wherein the peripheral region of the mouthpiece comprises one or more closed pockets of fluid. The fluid may be a gas or a liquid.

The mouthpiece may comprise a mouthpiece segment. The one or more closed pockets of air may be disposed in the peripheral region of the mouthpiece segment. The mouthpiece segment may be a segment, which is provided for at least one other purpose. For example, the mouthpiece segment may be a filter segment. This can enable the one or more pockets of air to be incorporated within an existing type of segment, and thus reduce or eliminate the need for a dedicated aerosol-cooling element within the mouthpiece.

The closed pockets of air may be provided at any longitudinal position on the mouthpiece. However, preferably the one or more closed pockets of air are disposed at least at the mouth end of the mouthpiece. Therefore, where the one or more closed pockets of air are disposed in the peripheral region of a mouthpiece segment, preferably the mouthpiece segment is disposed at the mouth end of the mouthpiece. This advantageously means that the insulation may be located in the region or regions of the article, which are most likely to come into contact with one or both of the user's lips and fingers when the aerosol-generating article is in use. The one or more pockets of air may be disposed within 12 millimetres of the mouth end of the article.

The mouthpiece segment may be substantially cylindrical. The mouthpiece segment may be in the form of a plug. The mouthpiece segment may have a length of at least about 5 millimetres. The mouthpiece segment may have a length of about 15 millimetres or less.

The mouthpiece segment may comprise a first component forming the inner region of the mouthpiece segment, and a second component forming the peripheral region of the mouthpiece segment. The first component may be gas permeable. The first component may comprise fibrous material. The fibrous material may comprise cellulose acetate fibers.

The mouthpiece segment may have a resistance to draw of from about 0.4 mm $H_2O$ to about 3 mm $H_2O$ per millimetre length. The aerosol-generating article may have a total resistance to draw of from about 0.6 mm $H_2O$ to about 1.5 mm $H_2O$ per millimetre length, or from about 0.8 mm $H_2O$ to about 1.2 mm $H_2O$ per millimetre length.

The mouthpiece may further comprise a wrapper circumscribing the mouthpiece segment, and the one or more pockets may be provided in the form of longitudinally extending channels in the mouthpiece segment. Each channel may be defined between a longitudinally extending groove in the outer surface of the mouthpiece segment and the inner surface of an overlying portion of the circumscribing wrapper.

Each longitudinally extending groove may be provided with first and second spaced apart blocking members to fill their respective grooves and close the channels at their respective upstream and downstream ends. The blocking members can therefore help to ensure that the pockets of air are fully closed, and thus prevent the air from mixing with the aerosol.

In some embodiments, the first blocking members may be provided as a single element, such as a single strip of material, which extends across the plurality of longitudinally extending grooves. In such embodiments, the first blocking member of each groove may have the same longitudinal position as the first blocking of each of the other grooves. Similarly, the second blocking members may be provided as a single element, such as a single strip of material, which extends across the plurality of longitudinally extending grooves. In such embodiments, the second blocking member of each groove may have the same longitudinal position as the second blocking of each of the other grooves.

In some embodiments, the first blocking members are provided as discrete elements within their respective grooves. For example, a first longitudinally extending groove may be provided with first and second spaced apart blocking members, and a second longitudinally extending groove may be provided with respective first and second spaced apart blocking members, which are distinct from the first and second spaced apart blocking members of the first longitudinally extending groove. In such embodiments, the first and second blocking members of the first groove may be positioned at a different longitudinal location to that of the first and second blocking members of the second groove. Such an arrangement is advantageous when the mouthpiece segment is formed from a continuous rod. In particular, such an arrangement is advantageous when the continuous rod is cut at discrete locations to form mouthpiece segments. This is because the arrangement enables a segment to be cut from the rod at any location along the rod's length, and still have a high likelihood of a closed pocket of air being formable in said segment. In other words, the arrangement reduces the importance, or eliminates the need for, registering the location of the blocking members with the location of the cuts in the rod forming each segment.

In some embodiments, at least some of the longitudinally extending grooves extend only along part of the length of the mouthpiece segment. For example, the upstream end, the downstream end, or both the upstream and the downstream ends of the mouthpiece segment may not comprise the longitudinally extending grooves. In such embodiments, each or both of the upstream and downstream ends of the mouthpiece segment may form a barrier which prevents air from escaping the pockets.

In some embodiments, the mouthpiece further comprises a wrapper circumscribing the mouthpiece segment, and the outer surface of the mouthpiece segment comprises one or more recessed cavities underlying the circumscribing wrapper. Each of the one or more pockets is defined between one of the recessed cavities and the inner surface of an overlying portion of the circumscribing wrapper. Such embodiments advantageously do not require the provision of additional blocking members; instead, the closed pockets of air can be simply formed between the outer surface of the mouthpiece segment and the overlying wrapper.

In embodiments where a wrapper circumscribes the mouthpiece segment, said wrapper may have a porosity of less than about 1000 Coresta units, more preferably less than about 500 Coresta units, and even more preferably less than about 100 Coresta units. The porosity may be as low as 100 Coresta units or lower, or 20 Coresta units or lower. In addition, or in the alternative, the porosity may be more than about 1 Coresta unit. Such low porosity wrappers can be particularly effective at preventing the air from escaping the closed pockets.

The combined volume of the one or more closed pockets may be at least about 10 cubic millimetres, more preferably at least about 20 cubic millimetres. Such values may be particularly suitable for a mouthpiece segment having a length of from about 5 millimetres to about 10 millimetres, and more preferably a length of about 7 millimetres.

Preferably, the combined volume of the one or more closed pockets may be at least about 1 cubic millimetres, per millimetre length of mouthpiece segment, more preferably at least about 2.5 cubic millimetres, per millimetre length of mouthpiece segment.

The combined surface area of the one or more closed pockets may be at least about 45 square millimetres, more preferably at least about 70 square millimetres. Such values may be particularly suitable for a mouthpiece segment having a length of from about 5 millimetres to about 10 millimetres, and more preferably a length of about 7 millimetres.

Preferably, the combined surface area of the one or more closed pockets may be at least about 6 square millimetres, per millimetre length of mouthpiece segment, more preferably at least about 10 square millimetres, per millimetre length of mouthpiece segment.

In some embodiments, the one or more closed pockets may comprise at least 10 closed pockets. In some embodiments, the one or more closed pockets may comprise at least 15 closed pockets. In some embodiments, the one or more closed pockets may comprise at least 20 closed pockets. Such values may be particularly suitable for a mouthpiece segment having a length of from about 5 millimetres to about 10 millimetres, and more preferably a length of about 7 millimetres.

In some embodiments, the mouthpiece segment comprises at least 1 closed pocket, per millimetre length of mouthpiece segment, more preferably the mouthpiece segment comprises at least 3 closed pockets, per millimetre length of mouthpiece segment.

Preferably, the one or more closed pockets are disposed around at least fifty percent of the circumference of the mouthpiece segment, more preferably, disposed around at least eighty percent of the circumference of the mouthpiece segment. In some embodiments, the one or more closed pockets are disposed around the entire circumference of the mouthpiece segment The insulation effects of the one or more pockets is particularly beneficial in the context aerosol-generating articles that are relatively short in length. Such articles include aerosol-generating articles in which an aerosol forming substrate, such as tobacco, is heated rather than combusted. This is because when the articles are relatively short, the aerosol has a shorter distance to travel through the article, and thus has less opportunity to cool as it passes through the article. Accordingly, preferably the aerosol generating article has a length of about 70 millimetres or less, more preferably a length of about 45 millimetres or less.

The aerosol-generating article of the present invention comprises an aerosol-forming substrate. As used herein, the term 'aerosol-forming substrate' relates to a substrate capable of releasing volatile compounds that can form an aerosol. Such volatile compounds may be released by heating the aerosol-forming substrate. An aerosol-forming substrate may be adsorbed, coated, impregnated or otherwise loaded onto a carrier or support. An aerosol-forming substrate may conveniently be part of an aerosol-generating article or smoking article.

The aerosol-generating article of the present invention may be configured for use with an aerosol-generating device. As used herein, an 'aerosol-generating device' relates to a device that interacts with an aerosol-forming substrate to generate an aerosol. The aerosol-generating article of the present invention may itself comprise a heat source and at least one heat-conducting element for transferring heat from the heat source to the aerosol-forming substrate of the article.

The aerosol-generating article of the present invention may be a smoking article, such as a filter cigarette or other smoking article, in which an aerosol-generating substrate comprises a tobacco material that is combusted to form smoke. Therefore, in any of the embodiments described above, the aerosol-generating substrate may comprise a tobacco rod. Furthermore, in any of the embodiments described above, the mouthpiece may be a filter. In such embodiments, the filter may be secured to the tobacco rod by a tipping paper.

The mouthpiece may comprise one or more segments disposed upstream of the mouthpiece segment. The one or more segments may include one or more of a support element, an aerosol-cooling element and a filter segment.

A support element may be located immediately downstream of the aerosol-forming substrate and may abut the aerosol-forming substrate. The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). In a preferred embodiment, the support element is formed from cellulose acetate. The support element may comprise a hollow tubular element. In a preferred embodiment, the support element comprises a hollow cellulose acetate tube. The support element preferably has an external diameter that is approximately equal to the external diameter of the aerosol-generating article. The support element may have an external diameter of between approximately 5 millimetres and approximately 12 millimetres, for example of between approximately 5 millimetres and approximately 10 millimetres or of between approximately 6 millimetres and approximately 8 millimetres. In a preferred embodiment, the support element has an external diameter of 7.2 millimetres +/−10%. The support element may have a length of between approximately 5 millimetres and approximately 15 mm. In a preferred embodiment, the support element has a length of approximately 8 millimetres.

An aerosol-cooling element may be located downstream of the aerosol-forming substrate, for example an aerosol-cooling element may be located immediately downstream of a support element, and may abut the support element.

As used herein, 'aerosol-cooling element' refers to a component of an aerosol-generating article located downstream of the aerosol-forming substrate such that, in use, an aerosol formed by volatile compounds released from the aerosol-forming substrate passes through and is cooled by the aerosol cooling element before being inhaled by a user. Preferably, the aerosol-cooling element is positioned between the aerosol-forming substrate and the mouthpiece. An aerosol cooling element has a large surface area, but causes a low pressure drop. Filters and other mouthpieces that produce a high pressure drop, for example filters formed from bundles of fibres, are not considered to be aerosol-cooling elements. Chambers and cavities within an aerosol-generating article are not considered to be aerosol cooling elements.

As used herein, the term 'rod' is used to denote a generally cylindrical element of substantially circular, oval or elliptical cross-section.

The plurality of longitudinally extending channels may be defined by a sheet material that has been crimped, pleated, gathered or folded to form the channels. The plurality of longitudinally extending channels may be defined by a single sheet that has been pleated, gathered or folded to form multiple channels. The sheet may also have been crimped. Alternatively, the plurality of longitudinally extending channels may be defined by multiple sheets that have been crimped, pleated, gathered or folded to form multiple channels.

As used herein, the term 'sheet' denotes a laminar element having a width and length substantially greater than the thickness thereof.

As used herein, the term 'longitudinal direction' refers to a direction extending along, or parallel to, the cylindrical axis of a rod.

As used herein, the term 'crimped' denotes a sheet having a plurality of substantially parallel ridges or corrugations. Preferably, when the aerosol-generating article has been assembled, the substantially parallel ridges or corrugations extend in a longitudinal direction with respect to the rod.

As used herein, the terms 'gathered', 'pleated', or 'folded' denote that a sheet of material is convoluted, folded, or otherwise compressed or constricted substantially transversely to the cylindrical axis of the rod. A sheet may be crimped prior to being gathered, pleated or folded. A sheet may be gathered, pleated or folded without prior crimping.

In some embodiments, the aerosol-generating article may not have an aerosol-cooling element. In this case, the mouthpiece segment may be located immediately downstream of the aerosol-forming substrate, or immediately downstream of the support element (if present). A cavity may be provided in the aerosol-generating article between the mouthpiece segment and the aerosol-forming substrate, or between the mouthpiece segment and the support element (if present). The cavity preferably extends from the aerosol-generating substrate to the mouthpiece segment, or from the support element (if present) to the mouthpiece segment.

The mouthpiece may be directly adjacent to the aerosol-forming substrate. The mouthpiece may be secured to at least a downstream portion of the aerosol forming substrate. For example, a wrapper such as a tipping wrapper may circumscribes the mouthpiece and at least a downstream end portion of the aerosol forming substrate to join the mouthpiece and aerosol-forming substrate together.

It will be appreciated that preferred features described above in relation to one aspect of the invention may also be applicable to other aspects of the invention.

Embodiments of the invention will now be described, by way of example only, with reference to the accompanying drawings, in which.

Figure 1:
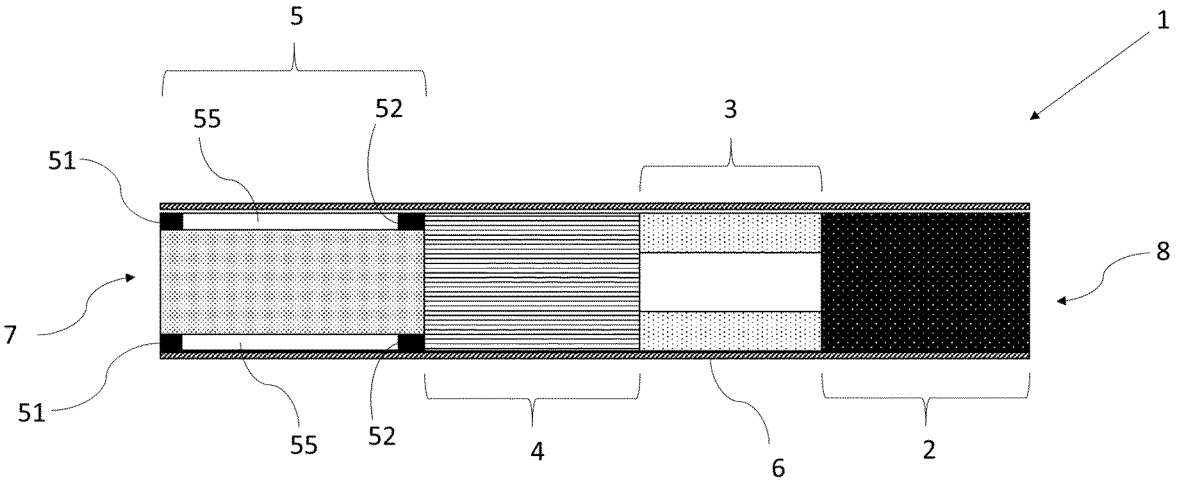
FIG. 1 is a schematic cross-sectional diagram of an aerosol-generating article in accordance with a first embodiment of the present invention.

FIG. 1 illustrates an aerosol-generating article 1 article in accordance with a first embodiment of the present invention. The aerosol-generating article 1 comprises four segments. The segments are: an aerosol generating substrate 2, a support element 3, an aerosol-cooling element 4 and a mouthpiece segment 5 in the form of a filter segment comprising cellulose acetate fibres.

The four segments are arranged sequentially and in coaxial alignment and are assembled by a cigarette paper 6 to form a rod. The rod has a mouth-end 7, which a user inserts into his or her mouth during use, and a distal end 8 located at the opposite end of the rod to the mouth end 7. Segments located between the mouth-end 7 and the distal end 8 can be described as being upstream of the mouth-end 7 or, alternatively, downstream of the distal end 8. When assembled, the rod is 52 millimetres long and has a diameter of 7.2 millimetres.

The mouthpiece segment 5 has at least two closed pockets of air 55 disposed in the peripheral region of the mouthpiece segment 5. Each pocket is enclosed by a portion of the outer surface of the mouthpiece segment 5, a portion of the inner surface of the wrapper 6, and respective first and second blocking members 51, 52.

Figure 2:
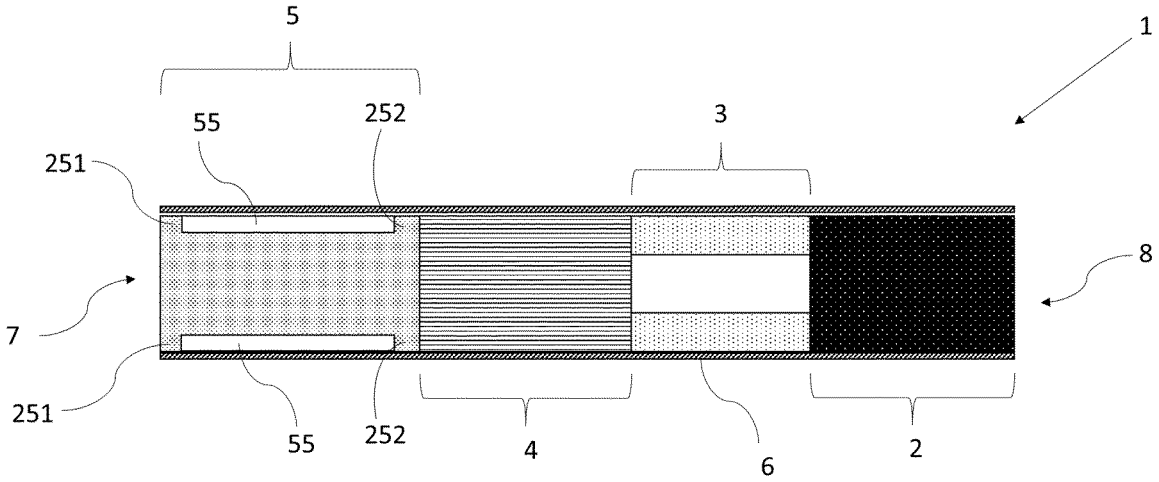
FIG. 2 is a schematic cross-sectional diagram of an aerosol-generating article in accordance with a second embodiment of the present invention.

FIG. 2 is a schematic cross-sectional diagram of an aerosol-generating article in accordance with a second embodiment of the present invention. The article 1 of FIG. 2 differs from the article 1 of FIG. 1, in that the mouthpiece segment 5 of FIG. 2 does not include blocking members for the closed pockets. Instead, both of the upstream and downstream ends 251, 252 of the mouthpiece segment form a barrier which prevents air from escaping the pockets. This can enable the mouthpiece to have a conventional appearance when viewed from the mouth end of the article 1.

Figure 3:
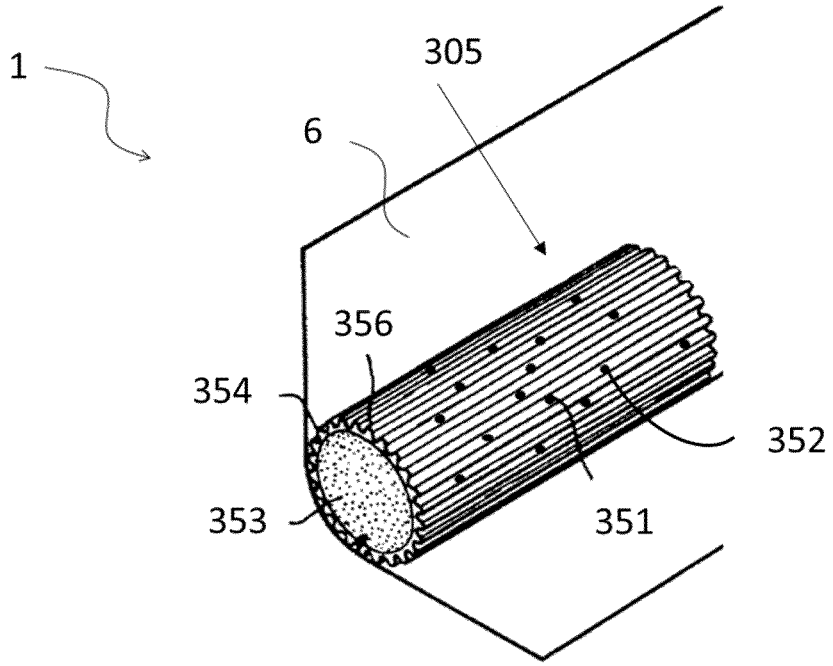
FIG. 3 shows a perspective view of a mouthpiece of an aerosol-generating article in accordance with a third embodiment of the present invention.

FIG. 3 shows a perspective view of a mouthpiece of an aerosol-generating article 1 in accordance with a third embodiment of the present invention. The mouthpiece is in an unwrapped configuration with the wrapper 6 not fully circumscribing the mouthpiece segment 305.

The mouthpiece segment 305 comprises a first component 353 forming the inner region of the mouthpiece segment 305, and a second component 354 forming the peripheral region of the mouthpiece segment 305. The first component 353 is a gas permeable component formed of cellulose acetate fibers. Aerosol is therefore able to flow through the first component 353 of the mouthpiece segment 305. The second component 356 is a moulded plastic sheath, which surrounds the first component353 . The outer surface of the sheath is formed with a plurality of longitudinally extending grooves 356 for defining the plurality of closed pockets.

Each longitudinally extending groove 356 is provided with first and second spaced apart blocking members 351, 352 to fill their respective grooves and close the channels at their respective upstream and downstream ends.

The first and second blocking members 351, 352 are provided as discrete elements within their respective grooves. As can be seen from FIG. 3, the first and second blocking members 351, 352 of a first groove may be positioned at a different longitudinal location to that of the first and second blocking members of a second groove. Such an arrangement is advantageous when the mouthpiece segment is formed from a continuous rod. In particular, such an arrangement is advantageous when the continuous rod is cut at discrete locations to form mouthpiece segments. This is because the arrangement enables a segment to be cut from the rod at any location along the rod's length, and still have a high likelihood of a closed pocket of air being formable in said segment. In other words, the arrangement reduces the importance, or eliminates the need for, registering the location of the blocking members with the location of the cuts in the rod forming each segment.

Figure 4:
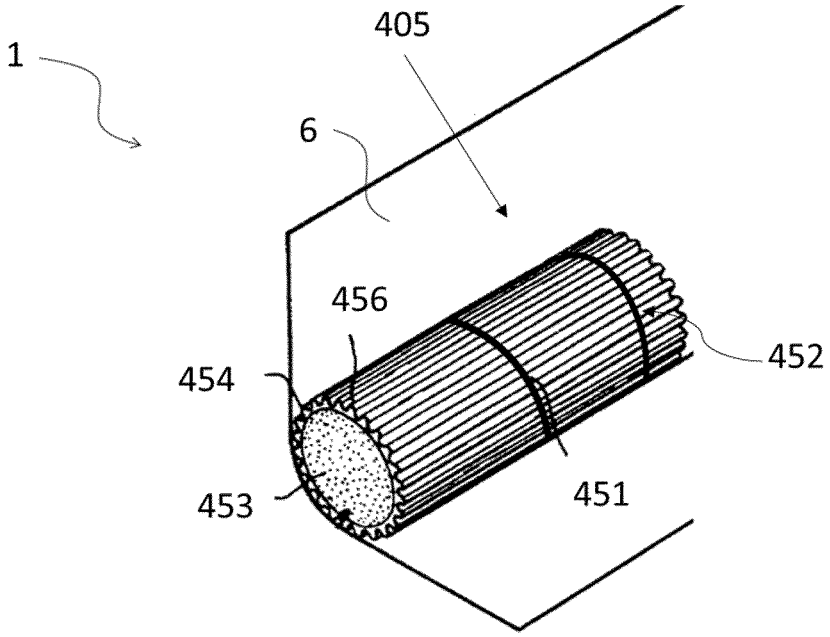
FIG. 4 shows a perspective view of a mouthpiece of an aerosol-generating article in accordance with a fourth embodiment of the present invention.

FIG. 4 shows a perspective view of a mouthpiece of an aerosol-generating article 1 in accordance with a fourth embodiment of the present invention. The mouthpiece is in an unwrapped configuration with the wrapper 6 not fully circumscribing the mouthpiece segment 405.

The mouthpiece segment 405 of FIG. 4 is similar to the mouthpiece segment 305 of FIG. 3, but differs in that the mouthpiece segment 405 of FIG. 4 has first and second blocking members 451, 452, which are provided as single elements, in the form of single strips of material, which extends across the plurality of longitudinally extending grooves 456. The first blocking member 451 of each groove has the same longitudinal position as the first blocking of each of the other grooves. Similarly, the second blocking member 452 of each groove has the same longitudinal position as the second blocking of each of the other grooves. Also similar to FIG. 3, mouthpiece segment 405 comprises a first component 453 forming the inner region of the mouthpiece segment 405, and a second component 454 forming the peripheral region of the mouthpiece segment 405.

Figure 5:
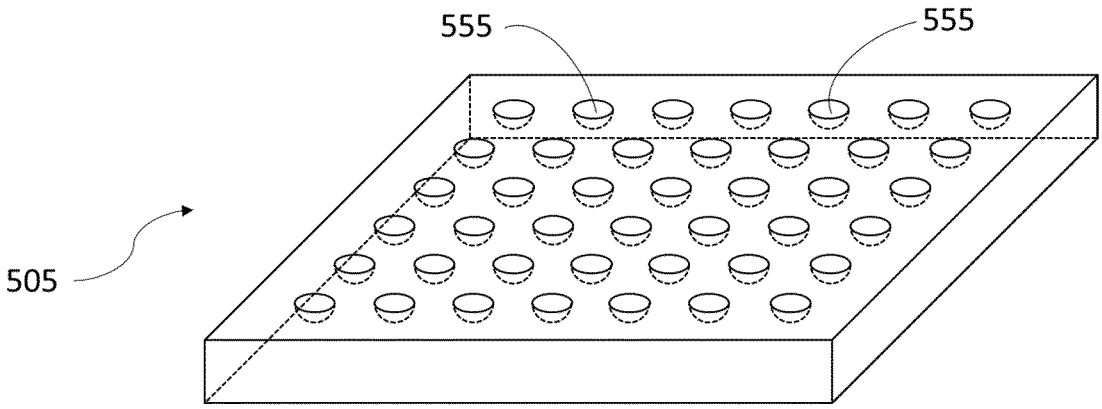
FIG. 5 shows a perspective view of the outer surface of a mouthpiece segment of an aerosol-generating article in accordance with a fifth embodiment of the present invention.

FIG. 5 shows a perspective view of the outer surface of a portion of a mouthpiece segment 505 of an aerosol-generating article 1 in accordance with a fifth embodiment of the present invention. In contrast to the embodiments shown in the likes of FIGS. 3 and 4, the closed pockets of air are not formed by longitudinal grooves in the outer surface of the mouthpiece segment. Instead, each of the one or more closed pockets is defined between one of a plurality of recessed cavities 555 on the outer surface of the mouthpiece segment 505, and the inner surface of an overlying portion of the circumscribing wrapper (not shown in FIG. 5). As a result, no blocking members are required in the FIG. 5 embodiment.

The invention claimed is:

1. An aerosol-generating article, comprising:
an aerosol-generating substrate; and
a mouthpiece disposed downstream of the aerosol-generating substrate,
wherein a peripheral region of the mouthpiece comprises one or more closed pockets of air,
wherein the mouthpiece further comprises a mouthpiece segment,
wherein the one or more closed pockets of air are disposed in the peripheral region of the mouthpiece segment,
wherein the mouthpiece further comprises a wrapper circumscribing the mouthpiece segment, and
wherein the one or more closed pockets of air are provided in a form of longitudinally extending channels, each channel of the longitudinally extending channels being defined between a corresponding longitudinally extending groove in an outer surface of the mouthpiece segment and an inner surface of an overlying portion of the circumscribing wrapper.

2. The aerosol-generating article according to claim 1, wherein the mouthpiece segment is disposed at a mouth end of the mouthpiece.

3. The aerosol-generating article according to claim 1, wherein the mouthpiece segment is substantially cylindrical.

4. The aerosol-generating article according to claim 1, wherein the mouthpiece segment comprises a first component forming an inner region of the mouthpiece segment, and a second component forming the peripheral region of the mouthpiece segment.

5. The aerosol-generating article according to claim 4, wherein the first component is gas permeable.

6. The aerosol-generating article according to claim 4, wherein the first component comprises fibrous filtration material.

7. The aerosol-generating article according to claim 1, wherein the corresponding longitudinally extending groove is provided with first and second spaced apart blocking members closing the channels at respective upstream and downstream ends thereof.

8. The aerosol-generating article according to claim 7,
wherein the corresponding longitudinally extending groove includes a first longitudinally extending groove and a second longitudinally extending groove,
wherein each of the first longitudinally extending groove and the second longitudinally extending groove is provided with the first and the second spaced apart blocking members, and
wherein the first and the second spaced apart blocking members of the first longitudinally extending groove are disposed at different longitudinal locations than that of the first and the second spaced apart blocking members of the second longitudinally extending groove.

9. The aerosol-generating article according to claim 1, wherein at least some of the longitudinally extending grooves extend only along part of a length of the mouthpiece segment.

10. An aerosol-generating article, comprising:
an aerosol-generating substrate; and
a mouthpiece disposed downstream of the aerosol-generating substrate,
wherein a peripheral region of the mouthpiece comprises one or more closed pockets of air,
wherein the mouthpiece further comprises a wrapper circumscribing a mouthpiece segment,
wherein the mouthpiece segment comprises one or more cavities recessed into an outer surface of the mouthpiece segment underlying the circumscribing wrapper, and
wherein each of the one or more closed pockets of air is defined between one of the recessed cavities and an inner surface of an overlying portion of the circumscribing wrapper.

11. The aerosol-generating article according to claim 1, wherein the wrapper circumscribing the mouthpiece segment has a porosity of less than 1,000 Coresta units.

12. The aerosol-generating article according to claim 10, wherein the wrapper circumscribing the mouthpiece segment has a porosity of less than 1,000 Coresta units.

13. The aerosol-generating article according to claim 1, wherein a combined volume of the one or more closed pockets of air is at least 20 $mm^3$.

14. The aerosol-generating article according to claim 1, wherein the aerosol-generating article has a length of 45 mm or less.

15. The aerosol-generating article according to claim 10, wherein the mouthpiece segment is disposed at a mouth end of the mouthpiece.

16. The aerosol-generating article according to claim 10, wherein the mouthpiece segment is substantially cylindrical.

17. The aerosol-generating article according to claim 10, wherein the mouthpiece segment comprises a first component forming an inner region of the mouthpiece segment, and a second component forming the peripheral region of the mouthpiece segment.

18. The aerosol-generating article according to claim 17, wherein the first component is gas permeable.

19. The aerosol-generating article according to claim 17, wherein the first component comprises fibrous filtration material.

20. The aerosol-generating article according to claim 1, wherein the one or more closed pockets of air are filled with a liquid.

* * * * *